US007431093B2

(12) United States Patent
Bearden et al.

(10) Patent No.: US 7,431,093 B2
(45) Date of Patent: Oct. 7, 2008

(54) PROTECTION SCHEME AND METHOD FOR DEPLOYMENT OF ARTIFICIAL LIFT DEVICES IN A WELLBORE

(75) Inventors: John L. Bearden, Claremore, OK (US); Jerald R. Rider, Catoosa, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/439,409

(22) Filed: May 23, 2006

(65) Prior Publication Data

US 2006/0207759 A1 Sep. 21, 2006

Related U.S. Application Data

(63) Continuation of application No. 10/260,706, filed on Sep. 30, 2002, now Pat. No. 7,048,057.

(51) Int. Cl.
*E21B 43/12* (2006.01)

(52) U.S. Cl. ..... 166/372; 166/106; 166/316; 166/105; 166/332.8; 166/242.3

(58) Field of Classification Search ..... 166/105.5, 166/68.5, 332.8, 242.3, 53, 313, 316, 105, 166/106, 369, 372
See application file for complete search history.

(56) References Cited

U.S. PATENT DOCUMENTS 1,076,302 A * 10/1913 McElroy ..... 137/875
2,423,111 A * 7/1947 O'Leary ..... 166/53
2,674,194 A 4/1954 Aruntunoff (Continued)

FOREIGN PATENT DOCUMENTS

EP 0 909 872 A2 4/1999

*Primary Examiner*—Richard E. Chilcot, Jr.
*Assistant Examiner*—Matt J Smith
(74) *Attorney, Agent, or Firm*—Fellers, Snider, Blankenship, Bailey & Tippens

(57) ABSTRACT

A protection system for an artificial lift device including but not limited to electrical submersible pump (ESP) and an electrical submersible progressing cavity pup (ESPCP). The artificial lift device is suspended on a tubing string into a wellbore where the artificial lift device contacts well fluids. The artificial lift device is provided with a barrier such as an intake barrier or output barrier that deters an ingress of well fluids into the artificial lift device. As a result, the artificial lift device may remain idle and submerged within well fluids for an extended period of time without experiencing degradation of the artificial lift device internals. The intake barrier may include a plug, burst disk, dissolvable material, a selectively openable barrier such as a sleeve or a spring biased member or other member that is capable of providing a suitable barrier. The barrier may be removed once the artificial lift device is ready for operation. The artificial lift device may be filled with a protective fluid. An optional pressure sensor may be provided that is in communication with the interior of the backup unit for communicating with a compressor that may be activated to maintain a positive pressure within the artificial lift device to prevent well fluids from entering the unit. The protection system of the invention is desirable for protecting an idle artificial lift device, including when the artificial lift device is a backup unit in a multi-artificial lift device deployment.

26 Claims, 5 Drawing Sheets

U.S. PATENT DOCUMENTS

| | | | | |
|---|---|---|---|---|
| 2,674,914 | A | 4/1954 | Arutunoff | |
| 2,783,400 | A | 2/1957 | Arutunoff | |
| 3,318,386 | A | 5/1967 | Garrett et al. | |
| 3,741,298 | A | 6/1973 | Canton | |
| 4,666,375 | A * | 5/1987 | Kime | 166/68.5 |
| 4,934,458 | A | 6/1990 | Warburton et al. | |
| 5,099,920 | A | 3/1992 | Warburton et al. | |
| 5,404,943 | A | 4/1995 | Strawn | |
| 5,975,209 | A | 11/1999 | McCorry | |
| 6,046,521 | A | 4/2000 | Heinig | |
| 6,089,322 | A * | 7/2000 | Kelley et al. | 166/105.5 |
| 6,092,599 | A | 7/2000 | Berry et al. | |
| 6,119,780 | A | 9/2000 | Christmas | |
| 6,167,965 | B1 * | 1/2001 | Bearden et al. | 166/105.5 |
| 6,201,327 | B1 | 3/2001 | Rivas | |
| 6,250,390 | B1 | 6/2001 | Narvaez et al. | |
| 6,508,308 | B1 * | 1/2003 | Shaw | 166/313 |
| 6,595,295 | B1 | 7/2003 | Berry et al. | |
| 7,048,057 | B2 | 5/2006 | Bearden et al. | |

* cited by examiner

PROTECTION SCHEME AND METHOD FOR DEPLOYMENT OF ARTIFICIAL LIFT DEVICES IN A WELLBORE

CROSS REFERENCE TO RELATED APPLICATION

This application is a continuation of and claims the benefit of U.S. patent application Ser. No. 10/260,706 entitled PROTECTION SCHEME AND METHOD FOR DEPLOYMENT OF ARTIFICIAL LIFT DEVICES IN A WELLBORE filed Sep. 30, 2002 which will issue into U.S. Pat. No. 7,048,057 on May 23, 2006.

BACKGROUND OF THE INVENTION

1. Field of the Invention

This invention relates generally to submersible artificial lift devices, and in particular to a single or multi-device system provided with a barrier to deter an ingress of well fluids into the device to reduce or prevent development of corrosion, formation of scale or asphaltenes or other problems in an idle device within a wellbore.

2. Background

Submersible artificial lift devices are widely used to pump fluid from a wellbore, particularly for purposes of hydrocarbon recovery. Examples of submersible artificial lift devices include an electrical submersible well pump (ESP) and an electrical submersible progressing cavity pump (ESPCP). Typically, an artificial lift device is suspended within a well from a flow conduit. The artificial lift device is submerged in well fluids. Prolonged inactivity and exposure to well fluids may damage motor and pump components of a typical artificial lift device. Therefore, it is desirable to protect the internals of an inactive artificial lift device when the device is submerged in wellbore fluids.

For example, U.S. Pat. No. 2,783,400 to Arutunoff teaches a protecting unit for an oil field submergible electrical motor. The protective unit provides a pathway for a lubricating and protecting fluid to expand or contract as a result of heating or cooling due to the electric motor. Additionally, the protecting unit essentially doubles the length of a path traveled by moisture or any contaminating fluid before such fluid can reach the pumping unit. One potential drawback of the protecting unit of Arutunoff is that the lengthened moisture path delays rather than prevents moisture migration to the pumping unit.

In some cases, it has been desirable to deploy multiple pumping units within a wellbore. Examples of multiple pumping units include the following:

U.S. Pat. No. 3,741,298 to Canton teaches a multiple well pump assembly wherein upper and lower pumps are both housed in a single wellbore hole and the pumps are connected in parallel so as to supplement each other's output. The pumps may be provided with different flow capacities and may couple with power means for running each pump individually or both simultaneously to provide a well pump system capable of selectively delivering three different effective flow rates from a single wellbore hole to satisfy varying flow demands.

U.S. Pat. Nos. 4,934,458 and 5,099,920 to Warburton et al. teach a small diameter dual pump pollutant recovery system. The system includes a water pump assembly and a pollutant pump assembly mounted at the lower end of piping, which serves to suspend the pumps in a well and also as an exhaust conduit for transporting pump water to the surface. The pollutant pump is used to recover lower density immiscible pollutants from the surface of the underground water table using the cone of the pressure method. The water pump may be raised and lowered to the position at the pollutant/water interface. A method of relocating the pollution intake and resetting the height of the cone of depression when conditions vary the height of the pollutant/water interface is also disclosed.

U.S. Pat. No. 5,404,943 to Strawn teaches a multiple pump assembly for wells. Strawn teaches a design to allow multiple submersible pumps in a single borehole. The multiple pump assembly provides flexibility in use of multiple pumps by allowing the user to avoid multiple well requirements through the use of standby or peak loading pumps.

U.S. Pat. No. 6,119,780 to Christmas teaches a wellbore fluid recovery system and method for recovering fluid from a wellbore that has at least one lateral wellbore extending out therefrom. The system includes a first electrical submergible pumping system for recovering fluids from a first zone of a wellbore and a second electrical submergible pumping system for recovering fluids from a second zone of a wellbore, such as a from a lateral wellbore. The fluid recovery system allows fluid recovery from each lateral wellbore to be independently controlled and also to provide adequate draw down pressure for each lateral wellbore.

U.S. Pat. No. 6,250,390 to Narvaez et al. teaches a dual electric submergible pumping system for producing fluids from separate reservoirs. A first submergible pumping system is suspended from deployment tubing and a second submergible pumping system is suspended from deployment tubing. The first submergible pumping system is connected to a fluid transport such that fluid may be discharged into the first fluid flow path, and a second submergible pumping system is connected to the fluid transport such that the fluid may be discharged into the second fluid flow path.

Typically, once an ESP is located below the static fluid level during deployment of the ESP into the well, wellbore fluid is free to enter into and fill the pump. If a blanking plug is installed, e.g. in a Y-Tool crossover, wellbore fluid is free to fill the open path in the pump and compress the air cap in the pump having a blanking plug in place. Depending on submergence pressure, the wellbore fluid may partially or substantially fully fill the pump.

A difficulty with having an idle unit that is at least partially filled with well fluid is that the idle unit is subject to the possibility of degradation of internal components including scale or asphaltenes precipitating out in the unit, which can cause either plugging of flow passageways and/or interference or locking of rotating components. Therefore, it is desirable to provide a protective environment for internals of the pump(s) that are held in backup or that have a delayed start-up. A protective environment increases the reliability of starting and running the pumps.

SUMMARY OF THE INVENTION

The present invention features an artificial lift device that is suspended on a flow conduit within a well. The artificial lift device is submerged in well fluids. A barrier is provided to prevent ingress of well fluids into the artificial lift device.

In many instances it is desirable to use multiple artificial lift devices in a single borehole. One advantage is that one device may be used as a primary pump and a second device may be used as a backup pump. One difficulty is that the static, or backup, unit sits idle and soaks in the wellbore environment, where the backup unit may be exposed to pressure cycles and possibly small temperature cycles. Possibilities exist for scale or asphaltenes to precipitate out in the unit. This can cause plugging of flow passageways and/or interference or locking of rotating components. By providing a barrier to protect the internal components of a backup unit or units from well fluid, the probability of damage to internal components is reduced.

In one embodiment, a multi-unit system of the invention is suspended on a tubing string into the wellbore. The multi-unit system has a junction, such as a Y-tool, T-connector or other type of junction having an upper end that communicates with production tubing and has a lower end having an operating unit port and a backup unit port. An operating unit communicates with the junction via the operating unit port and a backup unit communicates with the junction via the backup unit port. A barrier, such as a valve, blanking plug or other type of barrier is provided in the junction for selectively blocking off either the operating unit port or the backup unit port, thereby blocking fluid communication with either the operating unit or the backup unit. The backup unit is also provided with an intake barrier that deters ingress of well fluids into the backup unit. Therefore, the backup unit may remain submerged within well fluids for an extended period of time without experiencing degradation of the backup unit internals. The intake barrier may include a plug, burst disk, soluble material, a selectively openable intake barrier such as a sleeve or a spring biased member or other member that is capable of providing a suitable barrier.

In one embodiment, a pressure sensor is provided in communication with the interior of the backup unit. The pressure sensor communicates with a pressure producing device, such as a compressor, pump, or other device that may be activated to maintain a positive pressure within the backup unit to assist in preventing well fluids from entering the backup unit. A pressure sensor may also be provided in communication with the interior of the primary unit to detect a failure of the primary unit and to send a signal to an automated system to auto-activate the back-up unit. Alternatively, the pressure sensor may be used to send a warning to the surface, e.g., to a workstation, so that an operator may intervene to take appropriate action, such as starting the back-up unit in the event of primary unit failure.

The invention further includes a method of preserving pump integrity of an idle unit in a well, e.g., as a backup unit in a multiple unit system in a common wellbore. The method includes locating a multi-unit system in a wellbore wherein the multi-unit system includes an operating unit in communication with a junction and the backup unit in communication with a junction. A fluid barrier is provided in an output port output passageway, the junction, an intake port, or both ports or other combination of locations to deter ingress of well fluids into the backup unit. The backup unit is preferably filled with a protective fluid. The backup unit may be filled with protective fluid prior to deploying the multiple unit system within the wellbore or the backup unit may be filled, e.g., via a hydraulic communication line after the multiple unit system is deployed within the wellbore.

In one embodiment, a bubbler gage system may be used to deliver a fluid, such as an inert gas, to the backup unit. Typically, a bubbler gage system includes a fluid line extending from the surface to a location below the fluid level in a well, in this case to a submerged artificial lift unit. Fluid is then continuously delivered to the interior of the unit to maintain a positive pressure therein, which deters ingress of fluids into the unit. The bubbler gage also provides an additional benefit in that the well fluid level may be determined by noting when the pressure required to deliver additional fluid into the fluid line ceases to increase as a function of volume of fluid delivered.

To facilitate operation of the idle unit, the barrier is removed. The barrier may be removed by the application of additional pressure in the backup unit to push out a barrier or to burst a burst disk type barrier or by activating the unit to "pump out" a barrier. Additionally, if the barrier is comprised of a soluble material, then a solvent may be delivered to the backup unit to dissolve the fluid barrier. A selectively openable member may also be activated to open a flapper type valve, to slide a sliding sleeve, or to manipulate other types of selectively openable members. Examples of activators include, but are not limited to, a hydraulic line, an electric line in communication with a servo or an electric line to deliver a one time electrical pulse to activate a charge, a pneumatic line, or other means. Further, the barrier may be a spring-biased member that opens automatically by activation of the backup unit. Additionally, the barrier may be activated to open by rotation of the shaft in the unit. The barriers may also be opened to allow the fluid barrier to drain or flow out of the unit. Other types of barriers may also be used. Although the invention is described primarily as it relates to a protection scheme for a backup unit, it should be understood that the invention is also applicable to a single ESP unit that is to remain idle for a period of time while submerged in well fluids.

A better understanding of the present invention, its several aspects, and its advantages will become apparent to those skilled in the art from the following detailed description, taken in conjunction with the attached drawings, wherein there is shown and described the preferred embodiment of the invention, simply by way of illustration of the best mode contemplated for carrying out the invention.

DETAILED DESCRIPTION OF THE PREFERRED EMBODIMENT

Before explaining the present invention in detail, it is important to understand that the invention is not limited in its application to the details of the embodiments and steps described herein. The invention is capable of other embodiments and of being practiced or carried out in a variety of ways. It is to be understood that the phraseology and terminology employed herein is for the purpose of description and not of limitation.

Figure 1:
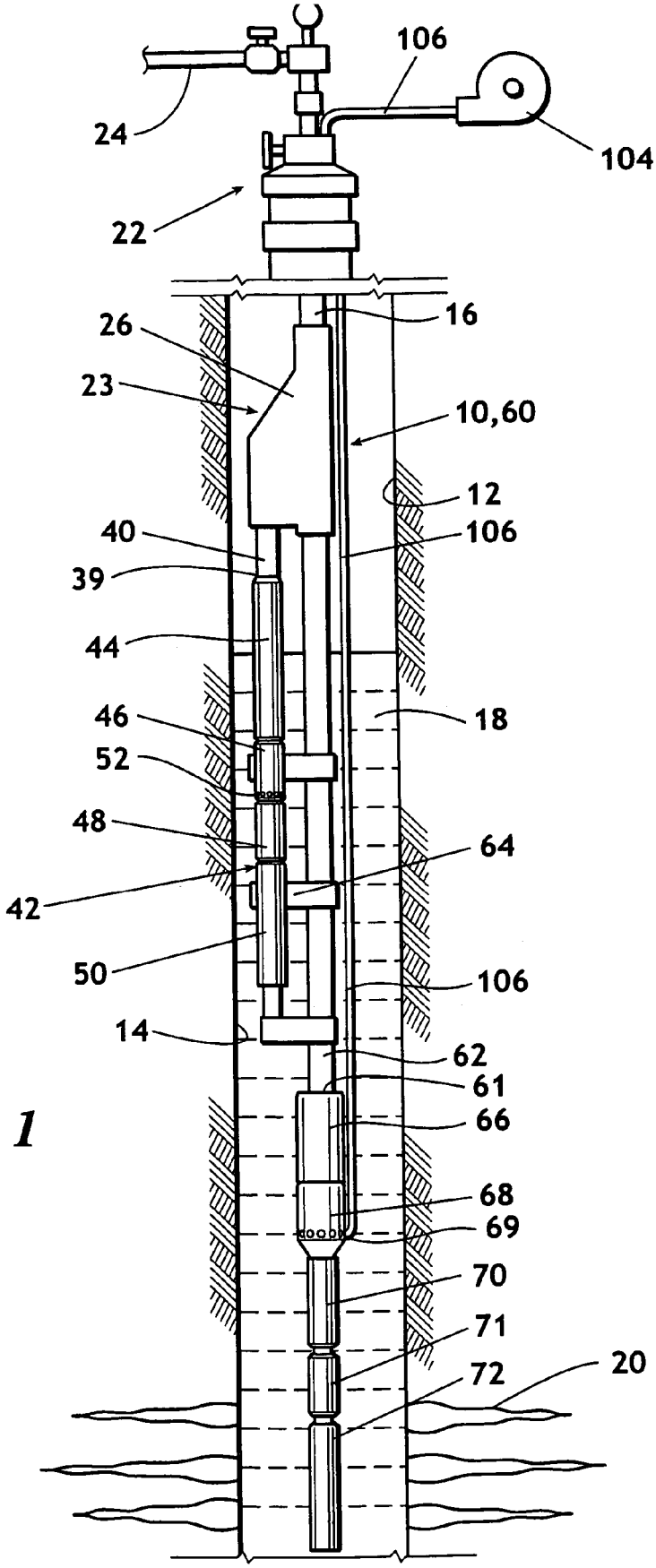
FIG. 1 is a schematic view of a multiple unit artificial lift system deployed in a wellbore.

Referring now to FIG. 1, shown is a multiple unit system designated generally 10. The multi-unit system 10 is deployed within wellbore 12. Wellbore 12 is lined with casing 14. A tubing string 16 carries the multiple unit system 10.

Figure 3:
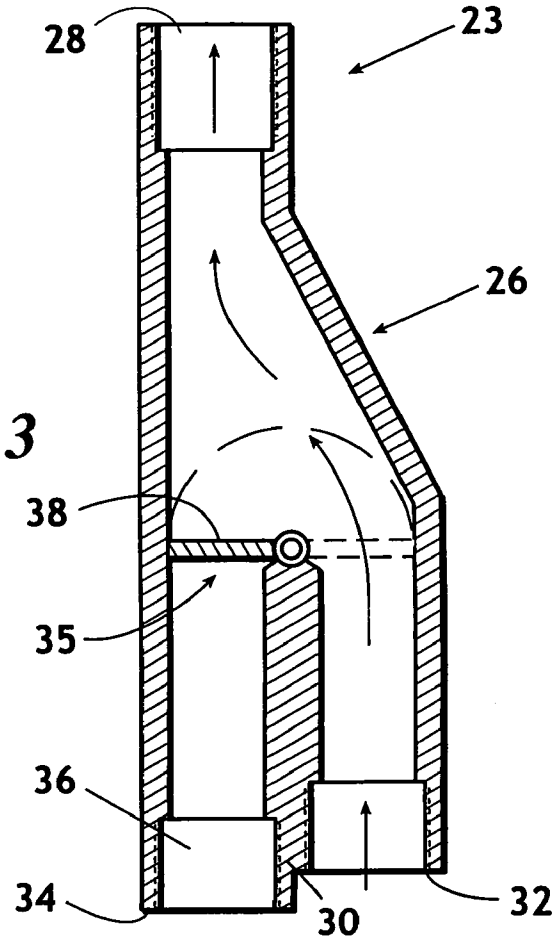
FIG. 3 is a cross-sectional view of a Y-Tool having a flapper valve installed therein.

Typically, the multiple unit system 10 is utilized to lift wellbore fluids 18 that enter the wellbore 12 through perforations 20. Wellbore fluids 18 are directed upward through tubing string 16, through wellhead 22, and to a production line 24. A junction, designated generally 23, such as Y-Tool crossover 26, is affixed to the lower end of the tubing string 16. As can be seen in greater detail in FIGS. 2 and 3, Y-Tool crossover 26 has an upper end 28 and a lower end 30, which is provided with a first unit port 32 and a second unit port 34. Typically, a junction 23, such as the Y-Tool crossover 26, is provided with an output barrier 35 in either the first unit port 32 or second unit port 34. Examples of output barriers 35 include a blanking plug 36 (FIG. 2) and a flapper valve 38 (FIG. 3). Flapper valve 38 is preferably capable of 180° rotation to selectively seal either the first unit port 32 or the second unit port 34. Further examples include a traveling ball used to selectively close a selected side. Although blanking plug 36 and flapper valve 38 are specifically shown in FIGS. 2 and 3, it should be understood that other types of output barriers may be suitable for use to selectively seal off either the first unit port 32 or the second unit port 34. Additionally, in some cases it may be desirable to directly seal off a discharge port 39 (FIG. 1) of the unit 42, or to locate a barrier in a first unit passageway 40, which extends upwards from the unit 42.

Referring back to FIG. 1, first unit passageway 40 communicates with first unit port 32 of Y-Tool 26. First unit passageway 40 delivers output from first unit 42 through Y-Tool 26 and up tubing string 16 to the surface. As shown, first unit 42 is an ESP having a centrifugal pump 44, a rotary gas separator 46, a seal section 48, and an electric motor 50. Typically, rotary gas separator 46 is provided with pump intakes 52. The electric motor 50 receives power from a cable, which transmits electric power to electric motor 50 from the surface.

The multiple unit system 10 of the invention is provided with a second unit 60, which may be used as a primary unit or as a back-up unit as desired. Second unit 60 communicates with the second unit port 34 of Y-Tool 26 via a second unit passageway 62. Second unit passageway 62 communicates with discharge port 61 of second unit 60. The second unit 60 and the second unit passageway 62 are preferably affixed to the first unit 42 via a series of clamps 64. As shown, second unit 60 is an ESPCP having a progressing cavity pump 66, a flex shaft section 68, a seal section 70, a gear reducer 71 and an electric motor 72. The electric motor 72 receives power from the surface via a cable. Second unit 60 is also provided with a fluid intake 74.

It should be understood that although FIG. 1 shows first unit 42 as an ESP and second unit 60 as an ESPCP, this arrangement is shown for example purposes only. Other combinations are possible and fall within the scope of the invention. For example, first unit 42 and second unit 60 may both be an ESP unit or may both be an ESPCP unit. First unit 42 may be an ESPCP unit and second unit 60 may be an ESP unit. Additionally, other types of artificial lift devices may be substituted for either or both the first unit 42 and second unit 60. Moreover, additional units 42, 60 may be provided in combination with additional junctions 23 so that three or more artificial lift devices may be provided in any combination of ESPs, ESPCPs, or other artificial lift devices. Finally, as shown in FIG. 1, the terms "first unit" and "second unit" are used for convenience only and it should be understood that either or both of the units may be operated or held as a backup as required. Still referring to FIG. 1, wherein first unit 42 is shown as an ESP and second unit 60 is shown as an ESPCP, it may be desirable to operate one or the other of units 42 and 60 depending upon well conditions or process preferences.

Referring now to FIGS. 4-9, in the preferred embodiment, first unit 42 and second unit 60 are provided with an intake barrier designated generally 100, which may be located in the pump intake 52 of the first unit 42 and in pump intake 74 of second unit 60 or intakes 208 and 238 (FIG. 10), discussed below, to prevent wellbore fluids 18 from entering the units 42, 60 when units 42, 60 are not in use. Although units 42, 60 are specifically referenced, it should be understood that FIGS. 4-9 are equally applicable to a stand-alone artificial lift unit or to an artificial lift unit in any multi-unit system configuration. A pressure sensor 101 may be provided to sense pressure within a unit 42, 60. Pressure information is communicated to the surface where a pressure producing device, such as compressor or pump 104 (FIG. 1), may be selectively operated to maintain pressure within the unit 42, 60 at a pressure above that of the wellbore fluids 18. The pressure producing device, such as compressor 104, communicates with the unit 42, 60 via a communication line, such as hydraulic line 106. Hydraulic line 106 is connected to the multiple unit system 10 at a location below the junction 23.

Figure 6:
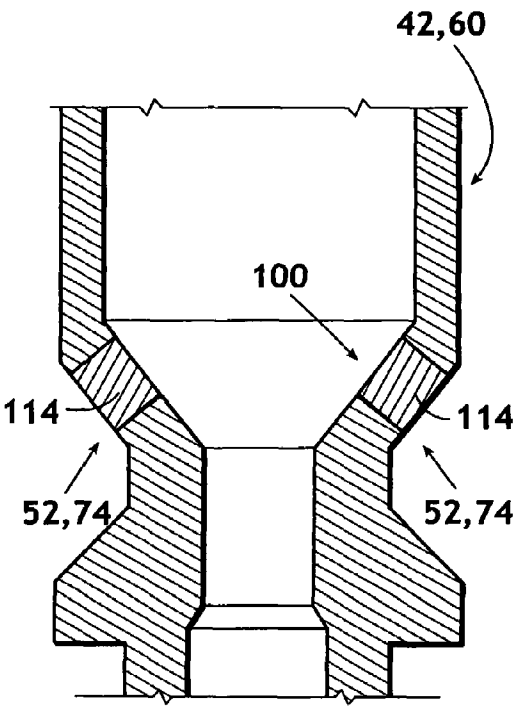
FIG. 6 is a perspective view of a soluble plug obstructing a pump intake port.
Figure 9:
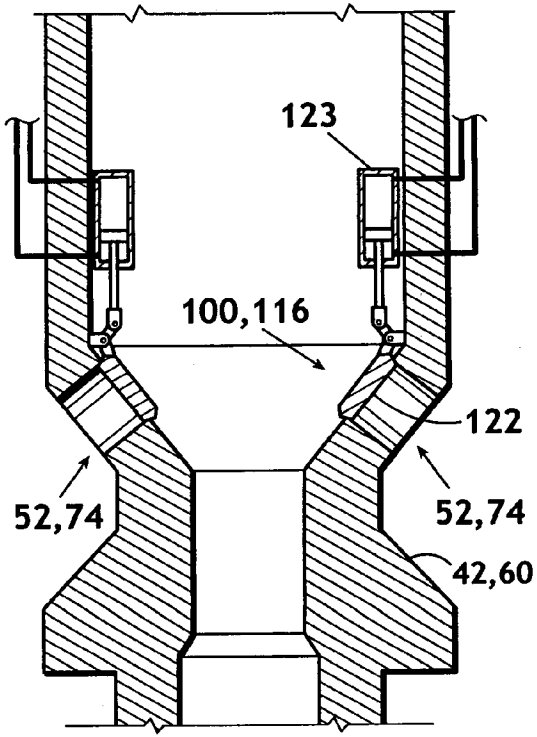
FIG. 9 is a perspective view of a hydraulically actuated flapper valve obstructing a pump intake port.
Figure 8:
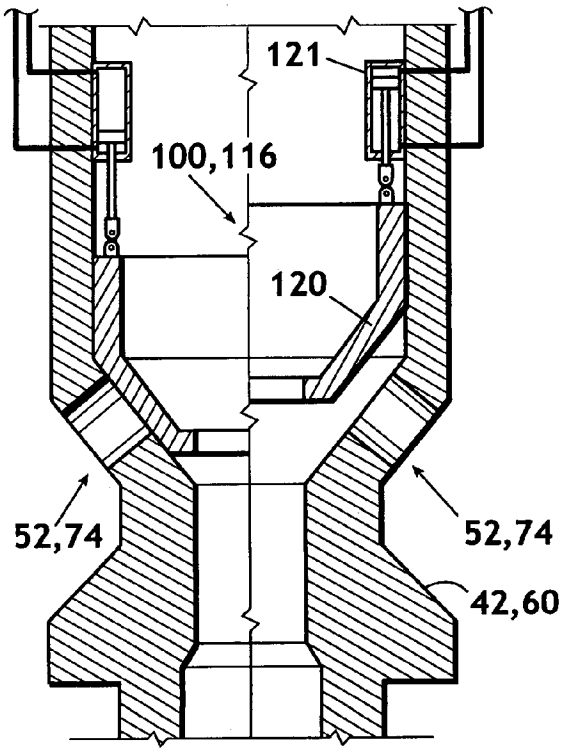
FIG. 8 is a perspective view of a sliding sleeve obstructing a pump intake port.
Figure 7:
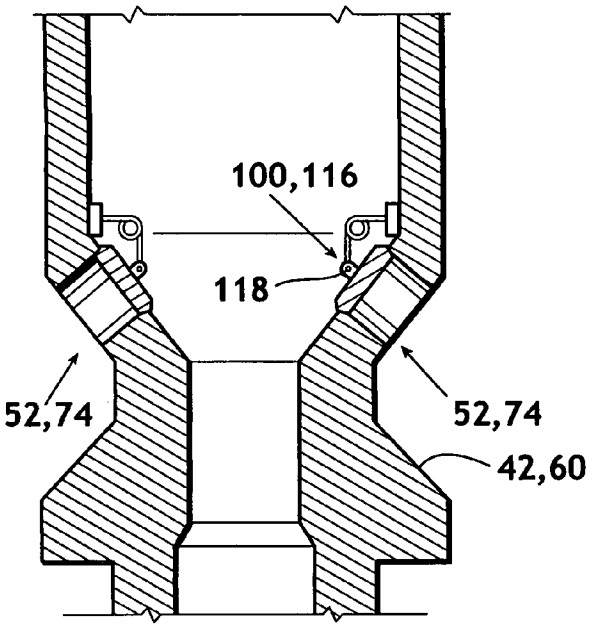
FIG. 7 is a perspective view of a spring-biased member obstructing a pump intake port.

Examples of intake barrier 100 include plug 108 (FIG. 4), burst disk 110 (FIG. 5), soluble plug 114 (FIG. 6), and a selectively openable member designated generally 116 (FIGS. 7-9). Selectively openable member 116 includes a spring biased member 118 as shown in FIG. 7, a sliding sleeve 120, actuated by a hydraulic system and hydraulic piston 121, as shown in FIG. 8, or flapper valve 122 actuated by hydraulic piston 123, as shown in FIG. 9. Other selectively openable members may also be used as required.

In practice, a method of preserving pump integrity of an idle unit, such as second unit 60 of a multiple unit system 10 is as follows. It should be understood that the method of preserving pump integrity is equally applicable to first pump 42 or to a stand alone artificial lift device, secondary back-up unit or other artificial lift device and that second unit 60 is used herein for purposes of example only. An intake barrier 100 is provided in pump intake 74 of the second unit 60 to deter ingress of well fluids 18 into the second unit 60. The second unit 60 is filled with a protective fluid to inhibit contamination of the second unit 60 within the wellbore 12. Examples of suitable protective fluids include but are not limited to a range of fluids having a generally lighter specific gravity, e.g. diesel, to protective fluids that have a generally heavy specific gravity, e.g. "Beaver Lube". Preferably, the protection fluids are inert with respect to component materials of the unit. Second unit 60 may be filled with protective fluid prior to deployment of multi-unit system 10 within the wellbore 12 or may be filled with protective fluid via hydraulic communication line 106 after multiple unit system 10 reaches setting depth. In one embodiment, pressure within the second unit 60 is at least periodically maintained at a level that is equal to pressure external of the second unit 60 in the wellbore. Pressure within the second unit 60 may be maintained via hydraulic communication line 106, which is operatively connected to a pressure producing device, such as compressor 104. Additionally, periodic flushing of the second unit 60 may be undertaken to assure continued protection over the time.

Figure 2:
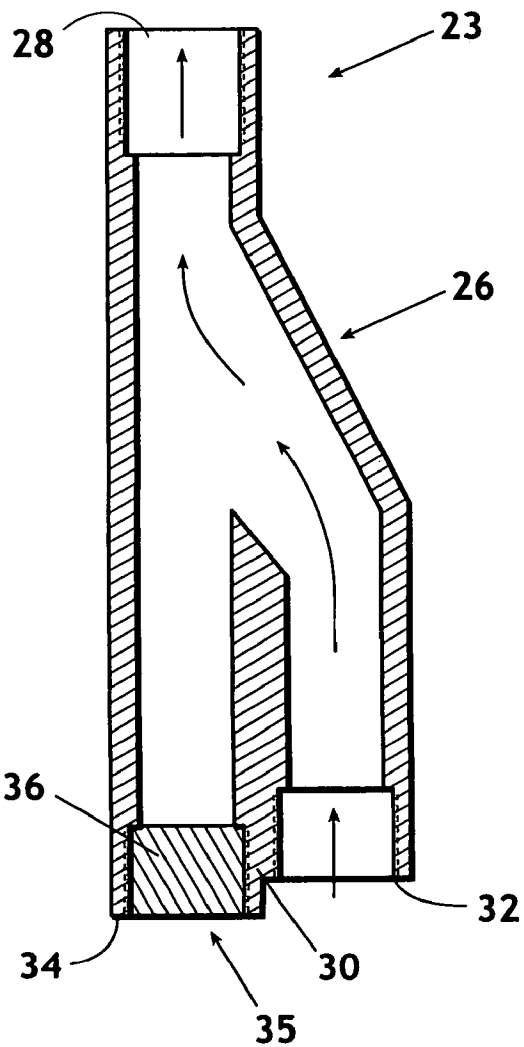
FIG. 2 is a cross-sectional view of a Y-Tool having a blanking plug installed therein.

If a protective fluid is used that has a heavier specific gravity than well fluids, then the unit 60 may be sealed with an intake barrier 100 since the protective fluid will tend to settle to the lower portions of the unit. Conversely, if a protective fluid is used that has a lighter specific gravity than well fluids, then a barrier may located in the junction 23, as shown in FIGS. 2 and 3, in passageway 40, 62, in output ports 39, 60 or at another location in the upper regions of units 42, 60. Such a barrier shall be referred to herein as an "output barrier". The lighter protective fluid will float on any well fluid present in the unit and, when held in place with an output barrier, will serve to prevent ingress of well fluids into the unit. Therefore, it can be seen that a protective fluid may prevent ingress of well fluids when used in conjunction with one of an intake barrier and an output barrier. Of course, barriers may be provided at both the intake and output regions and used with or without a protective fluid.

In operation, if an operating unit, e.g. first unit 42, fails or if it is desired to run first unit 42 and second unit 60 simultaneously, an intake barrier 100 and/or output barrier 35 must be removed from the pump intake 74 and/or the output region of the second unit 60. Similarly, if unit 60 is a stand alone unit in a well, e.g., if for some reason it is desirable to install the unit 60 and leave the unit idle for some period of time, then intake barrier 100 and/or output barrier 35 will be removed from pump intake 74 before operating unit 60.

Figure 4:
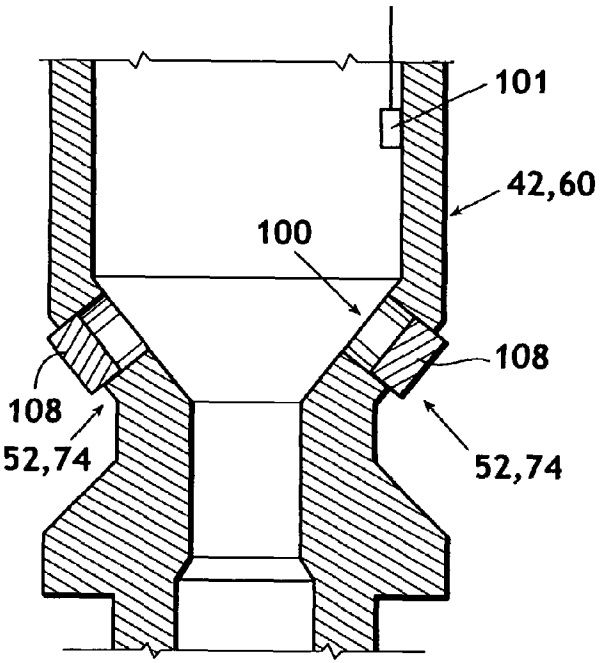
FIG. 4 is a perspective view of a barrier plug obstructing a pump intake port.
Figure 5:
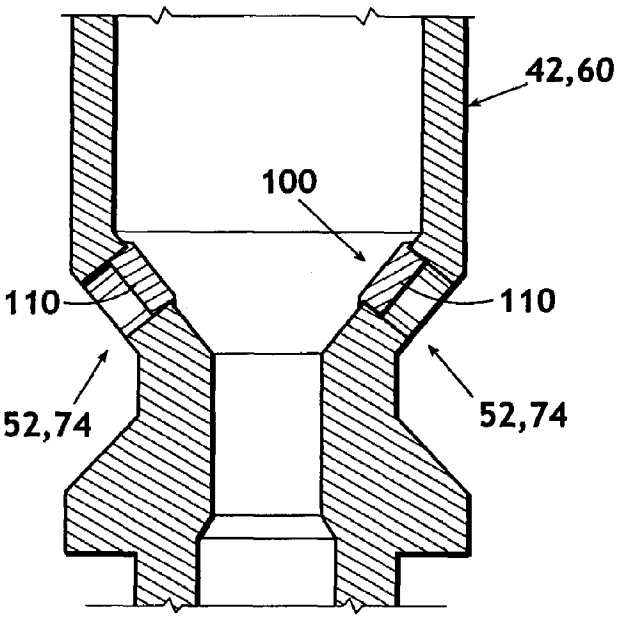
FIG. 5 is a perspective view of a burst disk obstructing a pump intake port.

One method of removing an intake barrier is to apply additional pressure within the backup unit 60 via hydraulic line 106 to push out the intake barrier 100, such as plug 108 (FIG. 4). Additionally, pressure may be delivered to the second unit 60 via hydraulic line 106 to burst a burst disk 110 (FIG. 5).

Further, in one embodiment, intake barrier 100 and/or output barrier 35 may be a soluble plug 114 (FIGS. 2 and 6). To remove soluble plug 114, a solvent is introduced through a passageway such as hydraulic line 106 into the unit 42, 60. Examples of suitable materials for a soluble plug include gels, solids, or other suitable materials. The solvent acts to dissolve soluble plug 114, thereby opening the pump intake 74 or pump output. Examples of suitable solvents include acids, e.g. hydrochloric acid, hydrofluoric acid, or other fluid treatments that are preferably not damaging to the unit or to the reservoir and which are preferably not soluble to well fluids. Hydraulic line 106 may be used to selectively activate a selectively openable member 116 (FIGS. 7-9). For example, pressure may be delivered to move a sliding sleeve 120 to expose the pump intake 74 (FIG. 8) or hydraulic pressure may be applied to open flapper valve 122 (FIG. 9), thereby opening pump intake 74. A pressure differential across pump intake 74 when the pump is running may be sufficient to open a spring biased member 118 to open pump intake 74 (FIG. 7). Additionally, sliding sleeve 120 (FIG. 8) and flapper valve 122 (FIG. 9) may be opened by internal pump pressure rather than by pressure via hydraulic line 106.

Although, second pump 60 has been shown as part of a multi-unit artificial lift system 10, the protection schemes of the invention could be utilized on multi-unit artificial lift systems having multiple backup pumps or the protection schemes of the invention could be utilized on a single artificial lift device deployed downhole, particularly where the single artificial lift device may not be started immediately.

Figure 10:
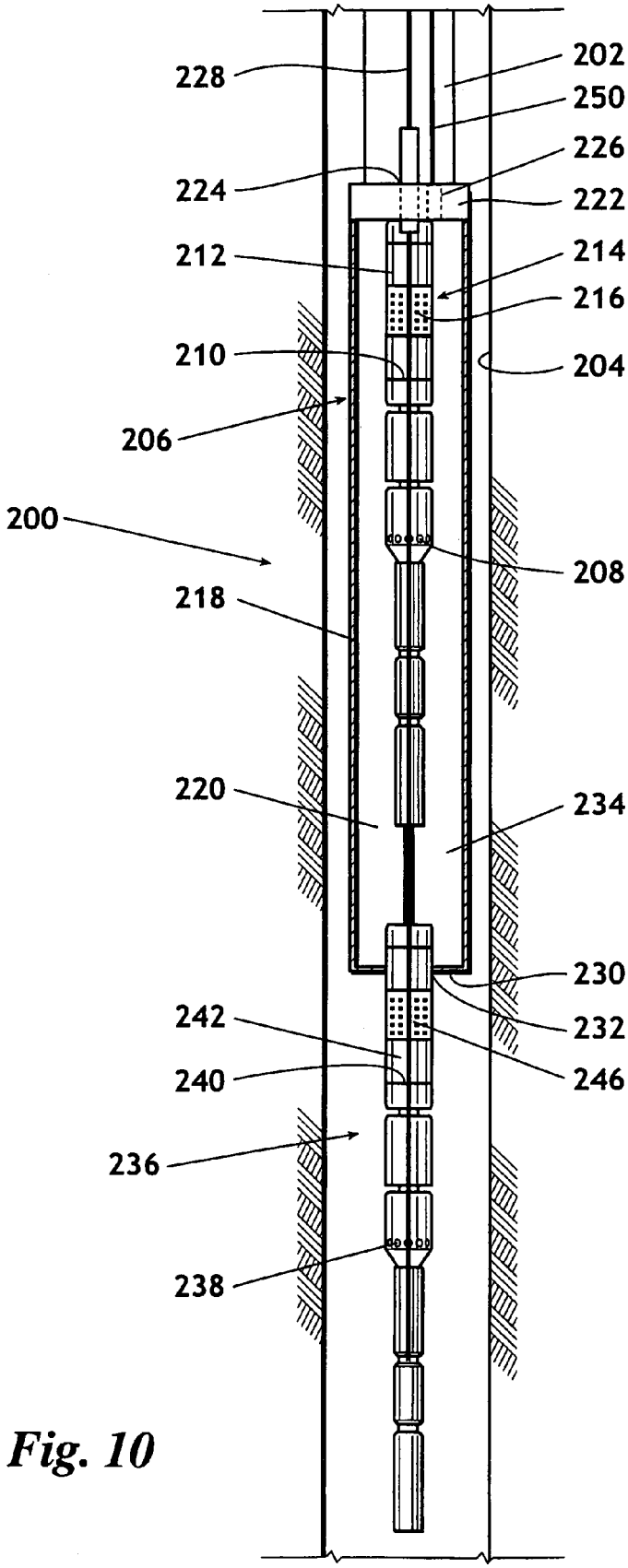
FIG. 10 is a cross-sectional view of a multi-unit in-line artificial lift system deployed in a wellbore.

Referring now to FIG. 10, an additional embodiment of a multi-unit system is shown. In particular, an in line POD system 200 is suspended from tubing 202 within a wellbore 204. An upper artificial lift device 206 has an intake port 208 and an output port 210. Upper artificial lift device 206 may be an ESP or an ESPCP or other types of submersible artificial lift devices. A passageway 212 communicates the output port 210 with the tubing 202. Passageway 212 has an upper selectively openable member 214 thereon. In one embodiment, the selectively openable member is a sliding sleeve 216 that may be positioned to selectively block fluid flow. Other types of selectively openable members may be used to allow selective flow from an outside to an inside passageway 212. Additional selectively openable members may include but are not limited to spring biased members similar to spring biased member 118 shown in FIG. 7 or may employ a hydraulic system and hydraulic piston similar to the hydraulic system and piston shown in FIG. 8, a flapper valve similar to the flapper valve 122 shown in FIG. 9, or other types of selectively openable member.

A shroud 218 surrounds the upper artificial lift device 206. Shroud 218 defines an annulus 220 between the upper artificial lift device 206 and the shroud 218. An upper closure member 222 is positioned on an upper end of shroud 218. The upper closure member 222 preferably has a first electric cable aperture 224 and a second electric cable aperture 226. A first cable 228 extends down through wellbore 204 through the first electric cable aperture 224 and provides power to the upper artificial lift device 206. A lower closure member 230 is provided on the lower end of shroud 218. The lower closure member 230 preferably has an aperture 232 located therein. The upper closure member 222 and the lower closure member 230 seal off ends of annulus 222 and define a sealed annular space 234.

A lower artificial lift device 236 is located below the upper artificial lift device 206. Lower artificial lift device 236 has an input port 238 that it is in communication with wellbore fluids in wellbore 204. Lower artificial device 236 additionally has an output port 240. The output port 240 is in communication with the aperture 232 and the lower closure member 230. Preferably, a passageway 242 communicates the output port 240 of the lower artificial lift device 236 with the annular space 234 by passing through aperture 232 in the lower closure member 230. Passageway 242 is additionally provided with a lower selectively openable member 246, which may be of the type described above with respect to upper selectively openable member 214. A second electric cable 250 extends through the second electric cable aperture 226 in the upper closure member 222. The second electric cable extends within annular space 234 and provides power to the lower artificial lift device 236. Second electric cable 250 may also extend through an aperture in lower closure member 230 similar to second electric cable aperture 226 in upper closure member 222, as required.

In operation, lower artificial lift device 236 may be provided with intake barriers 100 (FIGS. 4-9) to prevent well fluid from entering into the lower artificial lift device 236. The intake barriers may be of the type described above in reference to FIGS. 4-9. When lower artificial lift device 236 is used as a backup unit, intake ports 238 are provided with intake barriers 100. Lower selectively openable member 246 is opened to allow output fluid from lower artificial lift device 236 to pass through passageway 242 and into sealed annular space 234. Upper artificial lift device 206 then is able to draw wellbore fluids in through lower selectively openable member 246 through passageway 242 and into the annular space 234 where the fluids pass into intake port 208 of the upper artificial lift device 206. The upper artificial lift device 206 then forces wellbore fluids to the surface through passageway 212.

If upper artificial lift device 206 fails, or if it is desirable to run lower artificial lift device 236 while using upper artificial lift device 206 as a backup, then upper selectively openable member 214 is opened to allow wellbore fluids to pass therethrough. In this mode of operation, lower artificial lift device 236 intakes wellbore fluids through input ports 238. The wellbore fluid is driven out of output port 240 and through passageway 242 into the annular space 234 between the shroud 218 and upper artificial lift device 206. The wellbore fluid then flows past the upper artificial lift device 206 and through the open selectively openable member 214 and through passageway 212 and into tubing 202 where it can pass through the surface. Advantages of the POD system 200 include the ability to install dual or multi-unit systems in well casing having a smaller diameter as compared to multi-unit systems utilizing a junction, as shown in FIG. 1. The in-line POD system 200 permits multi-unit installation having larger pumps than does a Y-type multi-unit system in the same diameter of well casing. Additionally, a larger motor may be used for the lower artificial lift device 222 than is used for the upper artificial lift device 206 due to the pressure containment shroud 218, which surrounds the upper artificial lift device 206.

While the invention has been described with a certain degree of particularity, it is understood that the invention is not limited to the embodiment(s) set for herein for purposes of exemplification, but is to be limited only by the scope of the attached claim or claims, including the full range of equivalency to which each element thereof is entitled.

What is claimed is:

1. A well comprising;

well casing;

an electrical submersible artificial lift device deployed on a tubing string in said well casing;

said electrical submersible artificial lift device comprising a pump;

said pump having a housing defining an interior, said housing further defining a pump intake for providing fluid communication of said interior with well fluids; and a non-resealable barrier in sealing communication with said pump intake for preventing well fluid from entering said interior, said barrier selected from the group consisting of a plug, a burst disk, and a soluble material.

2. The well according to claim 1 further comprising:

a pressure sensor in communication with said artificial lift device; and a pressure producing device in fluid communication with said electrical submersible artificial lift device for pressurizing an inside of said electrical submersible artificial lift device in response to pressure data received from said pressure sensor.

3. The well according to claim 1 further comprising:

a hydraulic communication line in communication with an interior of said electrical submersible artificial lift device.

4. The well according to claim 1 further comprising:

a junction in fluid communication with said tubing string;

an operating unit in communication with said junction; and wherein said electrical submersible artificial lift device is a backup unit in communication with said junction.

5. A well comprising;

well casing;

an electrical submersible artificial lift device deployed on a tubing string in said well casing;

said electrical submersible artificial lift device comprising a pump;

said pump having a housing defining an interior, said housing further defining a pump intake for providing fluid communication of said interior with well fluids;

a non-resealable barrier in sealing communication with said pump intake for preventing well fluid from entering said interior, said barrier selected from the group consisting of a plug, a burst disk, and a soluble material;

a second electrical submersible artificial lift device in-line with said electrical submersible artificial lift device; and a shroud surrounding said second electrical submersible artificial lift device and said artificial lift device.

6. A well comprising;

well casing;

an electrical submersible artificial lift device deployed on a tubing string in said well casing;

said electrical submersible artificial lift device comprising a pump;

said pump having a housing defining an interior, said housing further defining a pump discharge port for providing fluid communication of said interior with well fluids; and a barrier in sealing communication with said pump discharge port for selectively preventing well fluid from entering said interior, wherein:

said non-resealable barrier is an output barrier in said discharge port of said electrical submersible artificial lift device, said barrier selected from the group consisting of a plug, a burst disk, and a soluble material.

7. The well according to claim 6 further comprising:

a pressure sensor in communication with said electrical submersible artificial lift device; and a pressure producing device in fluid communication with said electrical submersible artificial lift device for pressurizing an inside of said electrical submersible artificial lift device in response to pressure data received from said pressure sensor.

8. The well according to claim 6 further comprising:

a hydraulic communication line in communication with said electrical submersible artificial lift device.

9. The well according to claim 6 wherein said electrical submersible artificial lift device is part of a multi-unit artificial lift system comprising:

a junction;

an operating unit in communication with said junction; and wherein said electrical submersible artificial lift device is a backup unit in communication with said junction.

10. A well comprising:

well casing;

an electrical submersible artificial lift device deployed on a tubing string in said well casing;

said electrical submersible artificial lift device comprising a pump;

said pump having a housing defining an interior, said housing further defining a pump discharge port for providing fluid communication of said interior with well fluids; and a barrier in sealing communication with said pump discharge port for selectively preventing well fluid from entering said interior, wherein:

said non-resealable barrier is an output barrier in said discharge port of said electrical submersible artificial lift device;

wherein said electrical submersible lift device is part of a multi-unit artificial lift system comprising:

an upper unit;

a lower unit below said upper unit; and a shroud surrounding said upper unit.

11. A method of protecting an idle electrical submersible artificial lift device from well fluids comprising:

providing a non-resealable barrier in sealing communication with an intake port or discharge port to prevent well fluid from filling said electrical submersible artificial lift device wherein said barrier is selected from the group consisting of a plug, a burst disk, and a soluble material;

deploying said electrical submersible artificial lift device within a wellbore; and submerging said electrical submersible artificial lift device in well fluid.

12. The method according to claim 11 wherein said step of providing a barrier comprises:

locating said barrier in sealing communication with said intake port of said electrical submersible artificial lift device to prevent well fluid migration through said intake port into said electrical submersible artificial lift device.

13. The method according to claim 11 wherein said step of providing a barrier comprises:

locating said barrier in sealing communication with said discharge port in said electrical submersible artificial lift device to prevent well fluid migration into said electrical submersible artificial lift device.

14. The method according to claim 11 further comprising:

connecting a hydraulic communication line to said electrical submersible artificial lift device.

15. The method according to claim 14 further comprising the step of:

periodically maintaining a pressure in said electrical submersible artificial lift device that is at least equal to pressure external of said electrical submersible artificial lift device, said pressure maintained via said hydraulic communication line.

16. The method according to claim 11 wherein:

said step of applying said barrier in sealing communication with said intake port comprises covering said intake port with a selectively openable member activated via a communication line.

17. A method of protecting an idle electrical submersible artificial lift device from well fluids comprising:

providing a non-resealable barrier in sealing communication with an intake port or discharge port to prevent well fluid from filling said electrical submersible artificial lift device;

deploying said electrical submersible artificial lift device within a wellbore;

submerging said electrical submersible artificial lift device in well fluid; and filling said electrical submersible artificial lift device with a protective fluid.

18. The method according to claim 17 further comprising a step of flushing said electrical submersible artificial lift device with protective fluid.

19. The method according to claim 17 wherein:

said barrier is located in sealing communication with said intake port; and said protective fluid has a higher specific gravity than well fluid.

20. The method according to claim 17 wherein:

said barrier is located in sealing communication with said discharge port; and said protective fluid has a lower specific gravity than well fluid.

21. The method according to claim 17 wherein:

said step of filling said electrical submersible artificial lift device comprises locating said protective fluid within said electrical submersible artificial lift device prior to said step of deploying the electrical submersible artificial lift device within the wellbore.

22. The method according to claim 17 wherein:

said step of filling said electrical submersible artificial lift device comprises locating said protective fluid within said electrical submersible artificial lift device after said step of deploying the electrical submersible artificial lift device within the wellbore.

23. A method of protecting an idle electrical submersible artificial lift device from well fluids comprising:

providing a non-resealable barrier in sealing communication with an intake port or discharge port to prevent well fluid from filling said electrical submersible artificial lift device;

deploying said electrical submersible artificial lift device within a wellbore;

submerging said electrical submersible artificial lift device in well fluid; and applying additional pressure in said electrical submersible artificial lift device to push out said barrier.

24. A method of protecting an idle electrical submersible artificial lift device from well fluids comprising:

providing a non-resealable barrier in sealing communication with an intake port or discharge port to prevent well fluid from filling said electrical submersible artificial lift device;

deploying said electrical submersible artificial lift device within a wellbore;

submerging said electrical submersible artificial lift device in well fluid; and locating a solvent in said electrical submersible artificial lift device to remove said barrier.

25. A method of protecting an idle electrical submersible artificial lift device from well fluids comprising:

providing a non-resealable barrier in sealing communication with an intake port or discharge port to prevent well fluid from filling said electrical submersible artificial lift device;

deploying said electrical submersible artificial lift device within a wellbore;

submerging said electrical submersible artificial lift device in well fluid; and wherein said step of deploying the electrical submersible artificial lift device further comprises deploying a second electrical submersible artificial lift device and a shroud surrounding said second electrical submersible artificial lift device.

26. A well comprising:

well casing;

an electrical submersible artificial lift device deployed on a tubing string in said well casing;

said electrical submersible artificial lift device comprising a pump;

said pump having a housing defining an interior, said housing further defining a pump discharge port for providing fluid communication of said interior with well fluids; and a barrier in sealing communication with said pump discharge port for selectively preventing well fluid from entering said interior, wherein:

said non-resealable barrier is an output barrier in said discharge port of said electrical submersible artificial lift device; and wherein said barrier comprises a member biased in sealing engagement with said discharge port.

* * * * *